US005481770A

United States Patent [19]

Ahlsten

[11] Patent Number: 5,481,770

[45] Date of Patent: Jan. 9, 1996

[54] STRETCHER DEVICE

[76] Inventor: George E. Ahlsten, R.R. #2, Box 99, Wheaton, Minn. 56296

[21] Appl. No.: 129,684

[22] Filed: Sep. 30, 1993

[51] Int. Cl.[6] ..... A61G 1/00

[52] U.S. Cl. ..... 5/625; 5/628; 5/185; 5/623

[58] Field of Search ..... 5/617, 620, 625–628, 5/621–623, 185, 613; 296/20

[56] References Cited

U.S. PATENT DOCUMENTS

| | | | |
|---|---|---|---|
| 2,062,056 | 11/1936 | Herod | 5/125 X |
| 2,228,012 | 1/1941 | MacKenzie | 5/627 |
| 2,819,475 | 1/1958 | Ericsson | 5/617 |
| 3,039,119 | 6/1962 | Bourgraf et al. | 5/626 X |
| 3,840,221 | 10/1974 | Hogan | 5/625 X |
| 4,115,884 | 9/1978 | Keough | 5/625 |
| 4,373,222 | 2/1983 | Wolfe et al. | 5/623 X |
| 4,698,837 | 10/1987 | Van Steenburg | 5/123 X |
| 4,751,755 | 6/1988 | Carey, Jr. et al. | 5/617 X |

*Primary Examiner*—Michael F. Trettel
*Attorney, Agent, or Firm*—Robert E. Kleve

[57] ABSTRACT

The invention comprises a stretcher. The stretcher has an elongated rectangular frame and a U shaped frame with the ends of its legs pivotally mounted to the inside of the rectangular frame to pivot from a flush position inside and parallel with the rectangular frame to an upward angular position in relation to the rectangular frame to serve as a back rest for a patient upon the stretcher. A fluid actuated piston and cylinder are pivotally connected between the rectangular frame and the pivotable U frame to pivot the U frame to an upward angle relative to the rectangular frame. Slidable panels are slidably mounted on the U frame and rectangular frame to slide laterally away from the frame to provide an adjustable arm rest for a patient upon the stretcher.

10 Claims, 2 Drawing Sheets

FIG. 1
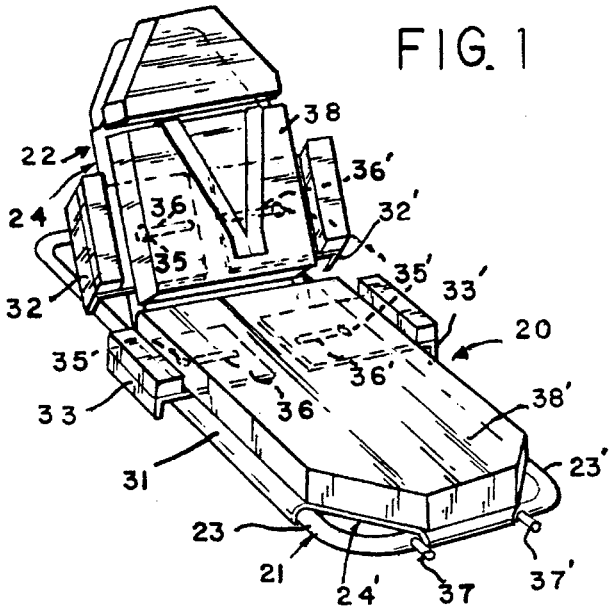
FIG. 4
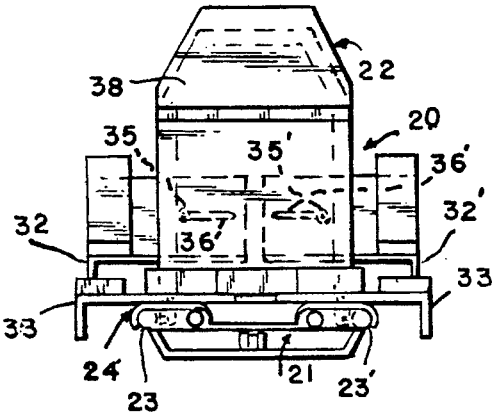
FIG. 2
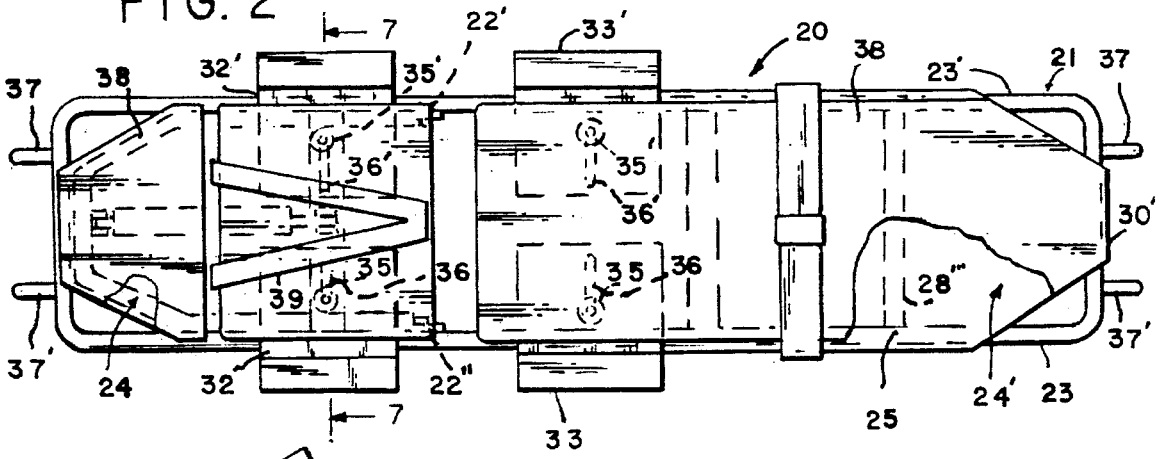
FIG. 3
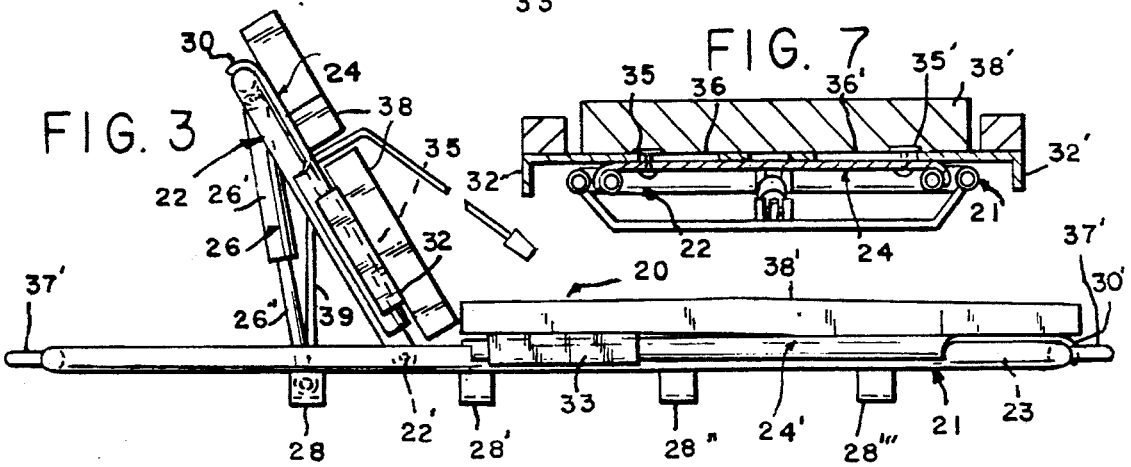
FIG. 7

STRETCHER DEVICE

It is an object of the invention to provide a novel stretcher which has adjustable back and arm rests for adapting the stretcher to support patients in different positions.

It is a further object of the invention to provide a novel stretcher with adjustable portions and can provide an arm support for a patient thereon.

It is a further object of the invention to provide a novel stretcher which can be readily assembled and manufactured with a minimum of time and effort.

Further objects and advantages of the invention will become apparent as the description proceeds and when taken in conjunction with the accompanying drawings wherein:

BRIEF DESCRIPTION OF THE DRAWINGS

FIG. 1 is a perspective view of the novel stretcher invention.

FIG. 2 is a top plan view of the stretcher invention.

FIG. 3 is a side elevational view of the novel stretcher invention with the back rest of the stretcher adjusted under air pressure upward at an angle.

FIG. 4 is a front elevational view of the stretcher invention.

FIG. 7 is a cross-sectional view taken along line 7—7 of FIG. 3.

BRIEF DESCRIPTION OF PREFERRED EMBODIMENT

Briefly stated, the invention comprises a stretcher for attachment to a bench wherein the bench may be detachably mounted in an aircraft for subsequent placement of a patient upon the stretcher. The stretcher has a tubular frame of a rectangular shape with a pivotally mounted partial U shaped tubular frame pivotally mounted at its legs to the tubular rectangular frame and serving as a back rest The stretcher has detachable panels for covering portions of the rectangular frame and U shaped partial frame with adjustable arm rests along the side of the partial U shaped frame and rectangular frame. The U shaped partial frame is pivotal from a flush position between the tubular rectangular frame to an angular position to serve as a back rest for the patient with the patient st least partly sitting up. Air actuated piston and cylinder structure is provided to power under air pressure the U shaped frame upward to rest as a back rest, moving from a flush to an angular position.

Figure 6:
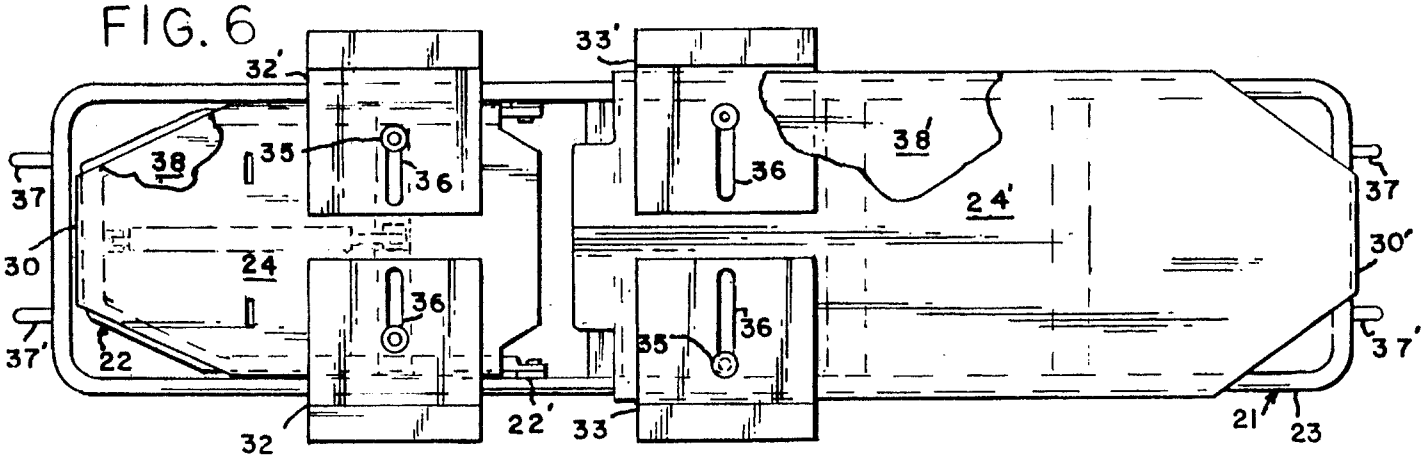
FIG. 6 is a top plan view of the stretcher with portions cut away to reveal the interior.
Figure 5:
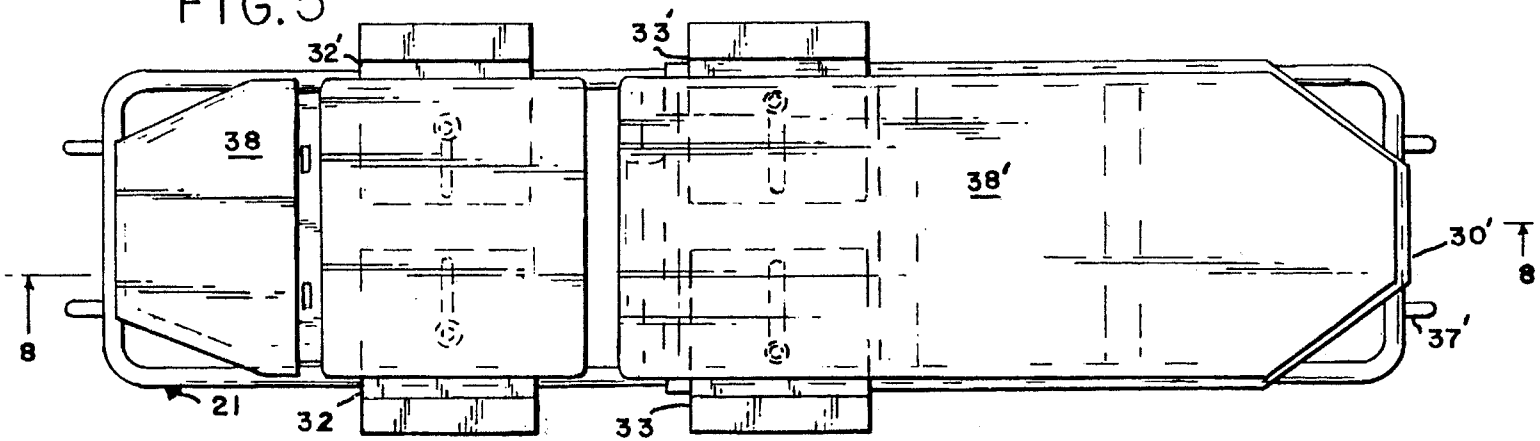
FIG. 5 is an enlarged top plan view of the stretcher invention.
Figure 8:
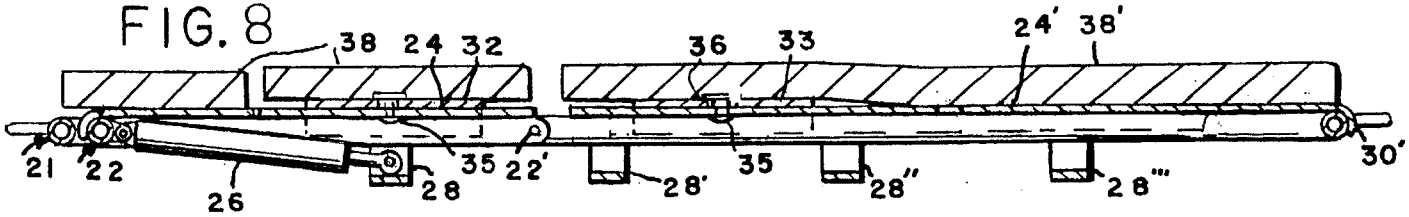
FIG. 8 is a cross-sectional view taken along line 8—8 of FIG. 5.

Referring more particularly to the drawings, in FIG. 1, the stretcher invention 20 is illustrated having a rectangular tubular frame 21 with a U shaped tubular partial frame 22 pivotally mounted at its legs at pivotal connections 22' to pivot from a flush position between the side bars 23 and 23' of the tubular rectangular frame, as illustrated in FIG. 8, to an angular position, as illustrated in FIGS. 1 and 2. A pair of sheet metal panels 24 and 24' are provided to cover most of the partial U shaped pivoting frame 22 and the lower portion 25 of the rectangular frame 21.

A fluid actuated cylinder 26 has a piston 26' with a cylinder 26" pivotally mounted to the apex 27 of the U shaped back rest tubular frame and the piston 26' is pivotally mounted to a brace member 28 extending laterally across the frame 21, fixed between the side bars 23 and 23' of the frame 21. Additional braces 28', 28", and 28'", similar to brace member 28, are also fixed laterally between the side members 23 and 23' and each bend downward at their intermediate portion 29.

Each of the panels 24 and 24' have curved outer ends 30 and 30' respectively and curved opposing side edges 31 and 31' respectively so that the panels 24 and 24' may be slid over the U frame 22 and the lower end 25' of the rectangular frame 21 with their uncurved edge first to slidably mount the panels 24 and 24' to the frame members 22 and 21 in a rapid manner and so that the panels may be quickly removed for cleaning the stretcher from time to time.

A pair of sliding arm support panels 32 and 32' are slidably mounted to the panel 24 on the U shaped frame 22. A similar pair of sliding panels 33 and 33' are slidably mounted on the frame panel 24' on the frame 21. The panels 32 and 32' and 33 and 33' are provided to support the arms of the patient near the shoulder of the patient while the sliding panels 33 and 33' are intended to support the arms near the wrists of the patient. Relatively narrow pads of cushioning material may be removably places on outer portions of the sliding panels if desired by applying adhesive to the panels and pad to frictionally adhere to one another under normal use and which adhesive material on the pads and on the panels will be able to separate from one another under minimum force if desired to allow the pads to be removed from one another. There are numerous conventional adhesive materials which might be used for this purpose.

The slidng panels 32 and 32' and 33 and 33' are provided to provide support for persons having shoulders wider than the width of the frames 21 and 22. The panels 24 and 24' each have bolts 35 which project upward from the panels through slots 36 in the panels 32,33,33,33' with enlarged heads 35' on the bolts larger than the width of the slots to retain the bolts in the slots of the panels 24 and 24' so that the panels 32,32',33,33' may be slid laterally toward and away from one another along the slots 36 with the panels sliding along the bolts with the bolts in the slots.

At each end of the rectangular frame 21 are a pair of pins 37 and 37' mounted thereon and which act in a conventional manner to receive the bores in mounting plates of a bench for locking the stretcher to a bench along the top of the bench.

Mounted on the top of the panel 24 of the U frame 22 is a cushion or pad 38 and a similar cushion or pad 38' is mounted along the top of the panel 24' to provide a cushion to the patient. A pair of safety belts 39 and 49 have their one ends mounted to the brace or channel 28 and their other ends extend through slots 40 in panel 24 where they connect with a pair of safety belts 41 and 41' which are mounted at their one ends to the sides 23 and 23' and extend together where they are connected together. Another set or pair of safety belts 42 have their one ends mounted to the side members 23 and 23' and have their other ends connected together.

The it will be seen that a novel inexpensive stretcher has been provided which can be adapted to carry patients of different sizes and in different positions.

It will be obvious that various changes and departures may be made to the invention without departing from the spirit and scope thereof, and accordingly, it is not intended that the invention be limited to that specifically described in the specification or as illustrated in the drawings but only as set for in the appended claims wherein:

What is claimed is:

1. A stretcher device having an elongated rectangular frame, a U shaped frame having its legs pivotally mounted to the rectangular frame to pivot from a flush position inside the rectangular frame and parallel with the rectangular frame to an upward angular position with respect to the rectangular frame, fluid actuated piston and and cylinder means pivotally connected between the apex of the U shaped frame and the rectangular frame whereby fluid actuation of piston and cylinder means will telescope the piston outward from the cylinder means to pivot the U shaped frame upward at an angle with respect to the rectangular frame, whereby the U shaped frame may serve as an inclined back rest for a patient and the portions of the rectangular frame beyond the pivotal mounted U shaped frame serving as a support for the lower body portions of the patient.

2. A stretcher device according to claim 1, wherein said rectangular frame and U shaped frame each have panel cover means with at least partially surrounding sides and at least one open portion whereby said panel cover means may be slid open portion first onto each of said frames for covering portions of each of said frames and at least partially surrounding the sides of the frames.

3. A mobile stretcher device comprising a rectangular frame having spaced parallel elongated rod side frame members and laterally connecting end rod members, a U shaped frame having parallel legs and having a laterally connecting end member connecting the parallel leg members together and forming an apex for the U shaped frame, said parallel legs being pivotally mounted to the inside of the rod side frame members to pivot the apex of the U shaped frame upward from the rectangular frame to an angle and pivotable downward to a position flush between the side frame members of the rectangular frame, cover panels for portions of the rectangular frame and pivotal U shaped frame, said cover panels having curved side edges and one end curved and an opposite open end whereby the cover panels may be slid onto the U shaped frame and rectangular frame by sliding the cover panels open end first onto the U shaped frame and rectangular frame with the curved side edges curving curving about the side frame members and parallel leg members of the frame and sliding therealong until the curved one end of each of the cover panels reaches and encircles the respective ends of the frames receiving the cover panels, said U shaped frame serving as a back and head rest for a patient placed upon the stretcher device and said rectangular frame portion receiving said U shaped frame along one end of said rectangular frame with said rectangular frame portion opposite the end of the rectangular frame receiving said U shaped frame serving to support the lower body portions of the patient thereon.

4. A stretcher device according to claim 3 wherein said device includes laterally slidable arm rest panels slidably mounted to the cover panel of the U shaped frame and a pair of laterally slidable arm rest panels slidably mounted to the cover panel of the rectangular frame with said arm rest panels serving as adjustable arm rests on each side of the cover panels of the device to support arm portions of the patient near the shoulder and near the hands of the patient.

5. A stretcher device comprising a horizontal elongated rectangular frame means and a movable back frame means movable upward angularly along one end of the elongated frame means for supporting the back of a patient thereon with the elongated frame means along an end opposite the one end serving to support the lower portions of the patient's body thereon, arm rest support panel means mounted on opposing lateral sides of at least one of said frame means and extendable laterally of the length of the elongated frame means outward in opposite directions laterally beyond the sides of the frame means to provide lateral arm rest supports for the patient supported on the back frame means and elongated rectangular frame means.

6. A stretcher device according to claim 5 wherein fluid actuated piston and cylinder means are connected between the movable back frame means and the rectangular elongated frame means and fluid actuated to telescope the piston outward from the cylinder to move the back frame means upward to an angle with respect to the horizontal elongated rectangular frame means to provide an adjustable upward angle back rest for the patient.

7. A stretcher device according to claim 6 wherein said arm rest support panel means includes adjustable arm rest support panel means mounted on opposite lateral sides of the rectangular frame means and adjustable outward in laterally opposite directions laterally beyond the sides of the rectangular elongated frame means to provide the arm rest supports for the patient.

8. A stretcher device according to claim 6 wherein said arm rest support panel means includes adjustable arm rest support panel means mounted on opposing lateral sides of the back frame means and adjustable outward in laterally opposite directions laterally beyond the sides of the rectangular elongated frame means and back frame means to provide the arm rest supports for the patient.

9. A stretcher device according to claim 8, wherein said rectangular frame means and the back frame means each have panel cover means with partially surrounding sides and at least one open portion whereby said panel cover means may be slid open portion first onto each of said frame means for covering portions of each of said frame means and at least partially surrounding each of the frame means.

10. A stretcher device comprising a horizontal elongated rectangular frame means having longitudinally opposing end portions and laterally opposing side portions; a movable back frame means movable upward at an angle beginning intermediate the ends of the rectangular frame and extending upward and outward and terminating above one of the end portions of the rectangular frame means to form an inclination for supporting the back of a patient thereon with the horizontal frame means along its other end serving to support the lower portions of a patient thereon; arm rest support panel means mounted on each opposing lateral side portion of the movable back frame means and along each lateral opposing side portion of the horizontal frame means along its other end and extendable outward in opposite lateral directions beyond the lateral side portions of the frame means to provide arm rest supports for the upper and lower portions, respectively, of the arms of the patient.

* * * * *